United States Patent [19]

Moon et al.

[11] 4,324,500

[45] Apr. 13, 1982

[54] MEANS TO INHIBIT PAPER FEED DURING CARRIAGE OR PRINT WHEEL MOVEMENT

[75] Inventors: Suhdok D. Moon, Los Altos; Marshall H. Trackman, San Leandro, both of Calif.

[73] Assignee: Qume Corporation, San Jose, Calif.

[21] Appl. No.: 178,682

[22] Filed: Aug. 15, 1980

[51] Int. Cl.[3] ..... B41J 29/54

[52] U.S. Cl. ..... 400/664; 400/144.2; 400/320; 400/322; 400/568; 400/582; 400/583

[58] Field of Search ..... 400/144.2, 144.3, 185, 400/279, 320, 322, 568, 582, 583, 663, 664, 665, 902, 903; 307/38, 239, 241, 242, 272 R, 272 A, 273, 328, 155

[56] References Cited

U.S. PATENT DOCUMENTS

| | | | |
|---|---|---|---|
| 3,844,395 | 10/1974 | Mero et al. | 400/568 X |
| 3,987,884 | 10/1976 | Buxton | 400/568 X |
| 4,114,750 | 9/1978 | Baeck et al. | 400/279 |
| 4,118,129 | 10/1978 | Grundherr | 400/144.2 |

*Primary Examiner*—Ernest T. Wright, Jr.
*Attorney, Agent, or Firm*—I Keschner

[57] ABSTRACT

A printer of the daisywheel type in which the existence of a carriage control signal and a printwheel control signal operate inhibiting apparatus for a control signal otherwise gated to a paper feed operator.

3 Claims, 1 Drawing Figure

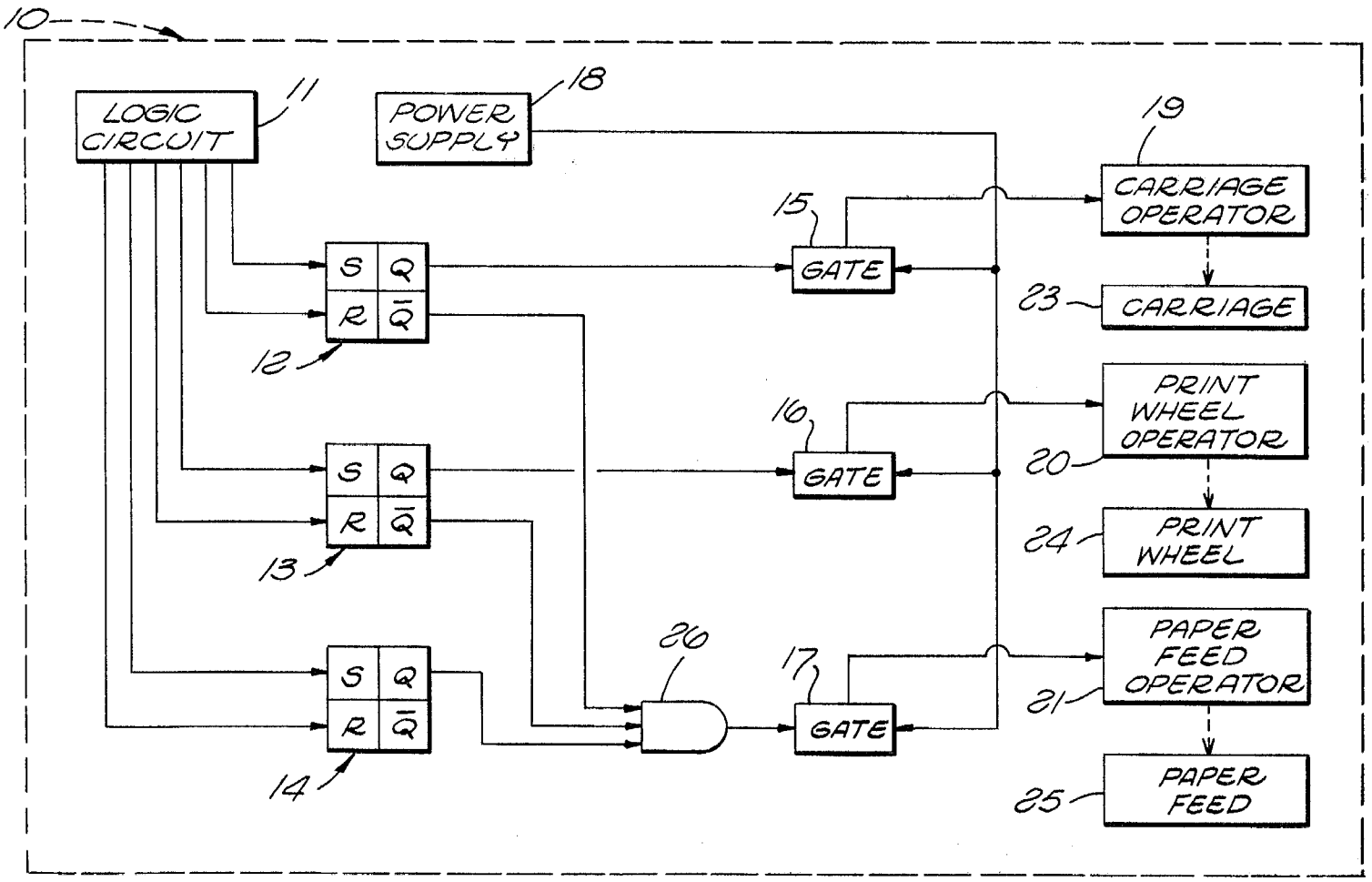
CARRIAGE OPERATOR
CARRIAGE
PRINT WHEEL OPERATOR
PRINT WHEEL
PAPER FEED OPERATOR
PAPER FEED
GATE
GATE
GATE
POWER SUPPLY
LOGIC CIRCUIT
S
Q
R
$\overline{Q}$
10
11
12
13
14
15
16
17
18
19
20
21
23
24
25
26

MEANS TO INHIBIT PAPER FEED DURING CARRIAGE OR PRINT WHEEL MOVEMENT

BACKGROUND OF THE INVENTION

This invention relates to printers employed in word processors or by themselves or with any other equipment, and more particularly to a printer requiring a small amount of electrical power.

PRIOR ART STATEMENT

In the past, high speed printers conventionally have had first, second and third means to provide carrier, printwheel and paper feed control signals, respectively, which cause carrier and printwheel movements at the same time, carrier and paper feed movements at the same time, printwheel and paper feed movements at the same time, and carrier, printwheel and paper feed movements at the same time.

The mode in which the carrier and/or the printwheel is moved simultaneously with the paper feed requires considerable electric power.

SUMMARY OF THE INVENTION

In accordance with the printer of the present invention, the above-described and other disadvantages of the prior art are overcome by gating paper feed operator current off when the carriage and/or printwheel is being driven.

BRIEF DESCRIPTION OF THE DRAWING

In the accompanying drawing which illustrates an exemplary embodiment of the present invention:

The FIGURE is a diagrammatic view of a printer constructed in accordance with the present invention.

DESCRIPTION OF THE PREFERRED EMBODIMENT

In the drawing, a printer is shown at 10 having a logic circuit 11, bistable devices 12, 13 and 14 connected from logic circuit 11, gates 15, 16 and 17 connected mediately or immediately from devices 12, 13 and 14, a power supply 18 connected to gates 15, 16 and 17, and carriage, printwheel and paper feed operators 19, 20 and 21 connected from gates 15, 16 and 17, respectively A carriage 23 is actuated by operator 19.

A printwheel 24 is actuated by operator 20.

A paper feed 25 is actuated by operator 21.

The "S" and "R" symbols represent the set and reset inputs of devices 12, 13 and 14. The Q output of device 12, when high, opens gate 15 to deliver electric current to operator 19 from power supply 18. Similarly, when the Q output of device 13 is high, gate 16 delivers electric current to operator 20 from power supply 18.

The maximum current to operator 21 is high and perhaps higher than at least that to one of the operators 19 and 20.

The logical output of an AND gate 26 is the product of the $\overline{Q}$ outputs of devices 12 and 13 and the Q output of device 14.

In operation, current from power supply 18 to operator 21 via gate 17 is interrupted when either one of the gates 15 and 16 is open. The peak transient and/or quiescent electrical loads are thus kept to a minimum.

Printer 10 may be entirely conventional except as described herein. For example, circuit 11, power supply 18, operators 19, 20 and 21, carriage 23, printwheel 24 and paper feed 25 all may be conventional. Typically, the conventional portions of printer 10 may be of the type disclosed in U.S. Pat. No. 4,118,129 issued Oct. 3, 1978. Operators 19, 20 and 21 may be identical to the corresponding operators disclosed in the said patent. The same is true of carriage 23, printwheel 24 and paper feed 25.

Devices 12, 13 and 14, gates 15, 16 and 17 and gate 26 may all be individually conventional, but the combination thereof with each other and with the remaining components 11 etc., is not.

In accordance with the foregoing, transient peak currents are minimized by interrupting the paper feed operator current with the carriage and printwheel overrides.

Typically the peak carriage current may be 3 amperes. The peak printwheel current may be 1.5 amperes. The peak paperfeed current may be 4.0 amperes. Miscellaneous current may amount to 0.5 ampere.

One or more or all of the currents to operators 19, 20 and 21 may be supplied to a conventional split-phase stepper motor requiring a certain minimum locking current provided by conventional means, not shown.

What is claimed is:

1. A printer comprising: a carriage; a carriage operator; a printwheel mounted on said carriage; a printwheel operator; a paper feed; a paper feed operator; and first means including a power supply actuable to deliver respective electric currents to said carriage operator, said printwheel operator, and said paper feed operator, said first means including second means to inhibit movement of said paper feed when either said carriage or said printwheel is being moved.

2. The invention as defined in claim 1, wherein said first means include first, second and third gates connected from said power supply to said carriage operator, to said printwheel operator and to said paper feed operator, respectively, first and second bistable devices having respective outputs connected to the control inputs of said first and second gates to open said first and second gates, a third bistable device, an AND gate connected from said third bistable device Q output to the control input of said third gate, said AND gate having a second input connected from respective $\overline{Q}$ outputs of said first and second bistable devices.

3. The method of minimizing peak power to a printer, said method comprising the steps of: providing logic having output means to produce first, second and third electrical signals to a movable printwheel operator, to a carriage operator, and to a paper feed operator, respectively, a printwheel being mounted on a carriage; and cutting off electric current to said paper feed operator when at least one of said first and second signals are produced as aforesaid.

* * * * *